US006053880A

United States Patent [19]

Sleichter, III

[11] Patent Number: 6,053,880

[45] Date of Patent: Apr. 25, 2000

[54] MASSAGING SYSTEM HAVING ISOLATED VIBRATORS

[75] Inventor: Charles G. Sleichter, III, Dana Point, Calif.

[73] Assignee: JB Research, Inc., Bellflower, Calif.

[21] Appl. No.: 09/149,894

[22] Filed: Sep. 8, 1998

[51] Int. Cl.[7] ..... A61H 23/00; A47C 7/02

[52] U.S. Cl. ..... 601/57; 601/70; 5/694; 5/915; 297/217.3

[58] Field of Search ..... 601/49, 56–61, 601/65, 67, 70, 78, 86, 90, 92, 98; 5/694, 701, 740, 915, 933–5, 944; 297/217.3, 452.37

[56] References Cited

U.S. PATENT DOCUMENTS

| | | | |
|---|---|---|---|
| 2,425,655 | 8/1947 | Tompkins . | |
| 3,551,924 | 1/1971 | Frye, Sr. . | |
| 4,136,685 | 1/1979 | Ramey | 601/57 |
| 4,326,506 | 4/1982 | Kawabata . | |
| 5,007,410 | 4/1991 | DeLaney . | |
| 5,188,096 | 2/1993 | Yoo . | |
| 5,344,437 | 9/1994 | Pistay . | |
| 5,429,585 | 7/1995 | Liang . | |
| 5,462,515 | 10/1995 | Tseng . | |
| 5,807,287 | 9/1998 | Cheng | 601/49 X |

FOREIGN PATENT DOCUMENTS

| | | | |
|---|---|---|---|
| 9009772 | 9/1990 | WIPO | 601/57 |

OTHER PUBLICATIONS

Relaxor® Massaging Mattress Topper brochure; JB Research, Inc., Los Angeles, CA; no date; 2 pp.

Relaxor® Stress Reducing Massage System brochure; JB Research, Inc., Los Angeles, CA; no date; 1 pp.

*Primary Examiner*—Danton D. DeMille
*Attorney, Agent, or Firm*—Sheldon & Mak

[57] ABSTRACT

A massaging system for equipment such as a vehicle includes a pad; a heater element, and motorized vibrators in respective regions of the pad; a plurality of vibratory transducers for location relative to plural zones of the seat; a controller for selectively activating the transducers. Each of the vibrators is in a cavity of a main cushion member, the cavity being closed by an outer cushion member that supports an occupant, a soft isolation member being interposed between the transducer and the main cushion member. The isolation member can completely enclose the transducer; alternatively, the transducer can be bonded to the outer cushion member or a reinforcing sheet that is laminated thereto, the isolation member only partially enclosing the transducer. The isolation of the vibrators from the main cushion member provides improved selectivity of particular regions of a user's body to be massaged. Also, in multiple seating installations, unwanted vibration of one seat is suppressed during activation of vibrators in an adjacent seat. Also disclosed is a method for converting a padded support to produce isolated massaging.

23 Claims, 4 Drawing Sheets

MASSAGING SYSTEM HAVING ISOLATED VIBRATORS

BACKGROUND

The present invention relates to massaging devices, and more particularly to massaging systems to be used in environments where radiated vibrations may be objectionable, such as in multiple seating structures and the like.

Typical massaging systems of the prior art include multiple vibrators that are imbedded in cushions or pads of beds, lounges, chairs and the like. See, for example, U.S. Pat. Nos. 5,188,096 to Yoo and 5,429,585 to Liang. It is also known to incorporate massaging vibrators in vehicle seats as disclosed in U.S. Pat. No. 5,462,515 to Tseng. A problem with these systems is that when there are multiple occupants, vibrators activated for the benefit of one occupant transmit significant and often objectionable vibrations to other occupants through shared padding and/or common structural elements. Although individual bucket seats are in common use by drivers and front seat passengers, they are less commonly provided for other passengers of automobiles and other vehicles. Accordingly, it has heretofore been impractical to provide bench seats of automobiles and passenger seats of aircraft with massaging systems.

A further problem is that users of massagers having pad-imbedded vibrators sometimes desire localized massaging only. However, the vibrations are transmitted with only gradual attenuation generally throughout the pad. Thus users are faced with the unwelcome choice of avoiding contact between the pad and particular body parts or putting up with unwanted vibrations.

Thus there is a need for a massaging system that overcomes the disadvantages of the prior art.

SUMMARY

The present invention provides a massaging system having localized massaging action. The motors are embedded in a padded user support, such as a vehicle seat, in a manner that avoids transmission of vibrations into structural members and adjacent seating, if present. In one aspect of the invention, a massaging system for an occupant support structure includes a vibrator unit located in the support structure; a controller circuit for selectively powering the vibrator unit for selectively stimulating an occupant of the structure, the vibrator unit being in a cavity of a main cushion member, the cavity being closed by an outer cushion member that supports the occupant, a flexible isolation member being interposed between the vibrator unit and the main cushion member, the isolation member having a bulk or volumetric stiffness being less than corresponding stiffnesses of the main and outer cushion members for isolating vibrations from the main cushion member.

A housing of the vibrator unit can have a generally cylindrical body portion and a plate portion, the plate portion facing the outer cushion member in generally parallel relation thereto. The plate portion can project beyond opposite sides of the body portion. The plate portion can project beyond opposite ends of the body portion. A lower portion of the housing body portion can be circularly cylindrical, having an outside diameter D, the housing also having a depth approximately corresponding to the diameter D in a direction perpendicular to the plate portion.

The plate portion can have a length A and a width B, the cavity having a length L and a width W, the width W being between 0.2 inch and 0.5 inch greater than the width B, the length L being between 0.2 inch and 0.5 inch greater than the length A. The housing can have a depth E, the cavity having a height H, the height H being between 0.2 inch and 0.5 inch greater than the depth E. The length L can be approximately 3.75 inch, the width W being approximately 2.75 inch. The height H can be approximately 1.5 inch. The isolation member can occupy at least 40 percent of an overall volume of the cavity.

The apparatus can further include a reinforcing sheet member laminated between the main cushion member and the outer cushion member. The outer cushion member can be of substantially uniform thickness. The thickness of the outer cushion member can be between 0.18 inch and 0.4 inch. Preferably the thickness of the outer cushion member is approximately 0.25 inch.

Preferably the vibrator unit is one of a spaced plurality of vibrators that are located in plural zones of the structure for selectively stimulating particular muscle groups of the occupant, each vibrator being located in a corresponding counterpart of the cavity and having a corresponding cushion liner interposed between the housing and the cavity. The outer cushion can cover each of the cavities. The main cushion and the outer cushion can form a seat pad of a seat. The massaging apparatus can be in combination with a back pad of the seat, the back pad having counterparts of the vibrators, the main cushion, the isolation members, and the outer cushion. The seat can be one of a plurality of seats having a common structural element.

In another aspect of the invention, a vehicle seat includes a structural member, a seat pad and a back pad supported relative to the structural member, the seat pad and the back pad each including a plurality of vibrator units, each vibrator unit having a housing, a motor supported within the housing, means for connecting the motor to a source of electrical power, the motor being coupled to a mass element for producing vibratory motion of the housing; a main cushion member having a main supporting surface and being formed of a resilient material having a first volumetric stiffness, a plurality of spaced apart cavities being formed therein and interrupting the supporting surface for receiving respective ones of the vibrator units, each cavity being sufficiently large to provide clearance space on all sides of the corresponding vibrator unit; a plurality of isolation members, each isolation member having a second volumetric stiffness being less than the first volumetric stiffness, the isolation member covering at least a portion of a vibrator unit and being interposed between the vibrator unit and the main cushion member; and an outer cushion member having a third volumetric stiffness being greater than the second volumetric stiffness, the outer cushion member being bonded to the main supporting surface and covering the cavities, the outer cushion member forming an outer supporting surface being spaced from the main supporting surface. The massaging apparatus can further include a controller electrically connected to each of the vibrators for activating selected ones of the vibrators.

In a further aspect of the invention, a method for converting a padded support device to produce isolated massaging of a user's body, the device including a main cushion having a first bulk stiffness, includes the steps of:

(a) providing a vibratory transducer having a housing and a control cable extending from the housing for driving the transducer;

(b) enclosing at least a portion of the transducer housing in a resilient isolation material having a second bulk stiffness being less than the first bulk stiffness;

(c) forming a cavity in a supporting surface of the main cushion, the cavity being sufficiently large for receiving the combination of the transducer housing and the isolation material;

(d) placing the transducer housing together with the isolation material in the cavity;

(e) positioning the control cable to extend from the cavity and on the supporting surface to an edge margin thereof;

(f) providing a resilient pad member for covering the supporting surface;

(g) bonding a reinforcing sheet member to a bottom surface of the pad member; and (h) bonding the sheet member to the supporting surface, the sheet member being laminated between the main cushion and the pad member and covering the cavity.

The step of enclosing can include completely enclosing the transducer housing with the isolation material, the isolation material preferably having a volume of not less than 40 percent of a volume of the cavity.

DRAWINGS

These and other features, aspects, and advantages of the present invention will become better understood with reference to the following description, appended claims, and accompanying drawings, where:

DESCRIPTION

Figure 1:
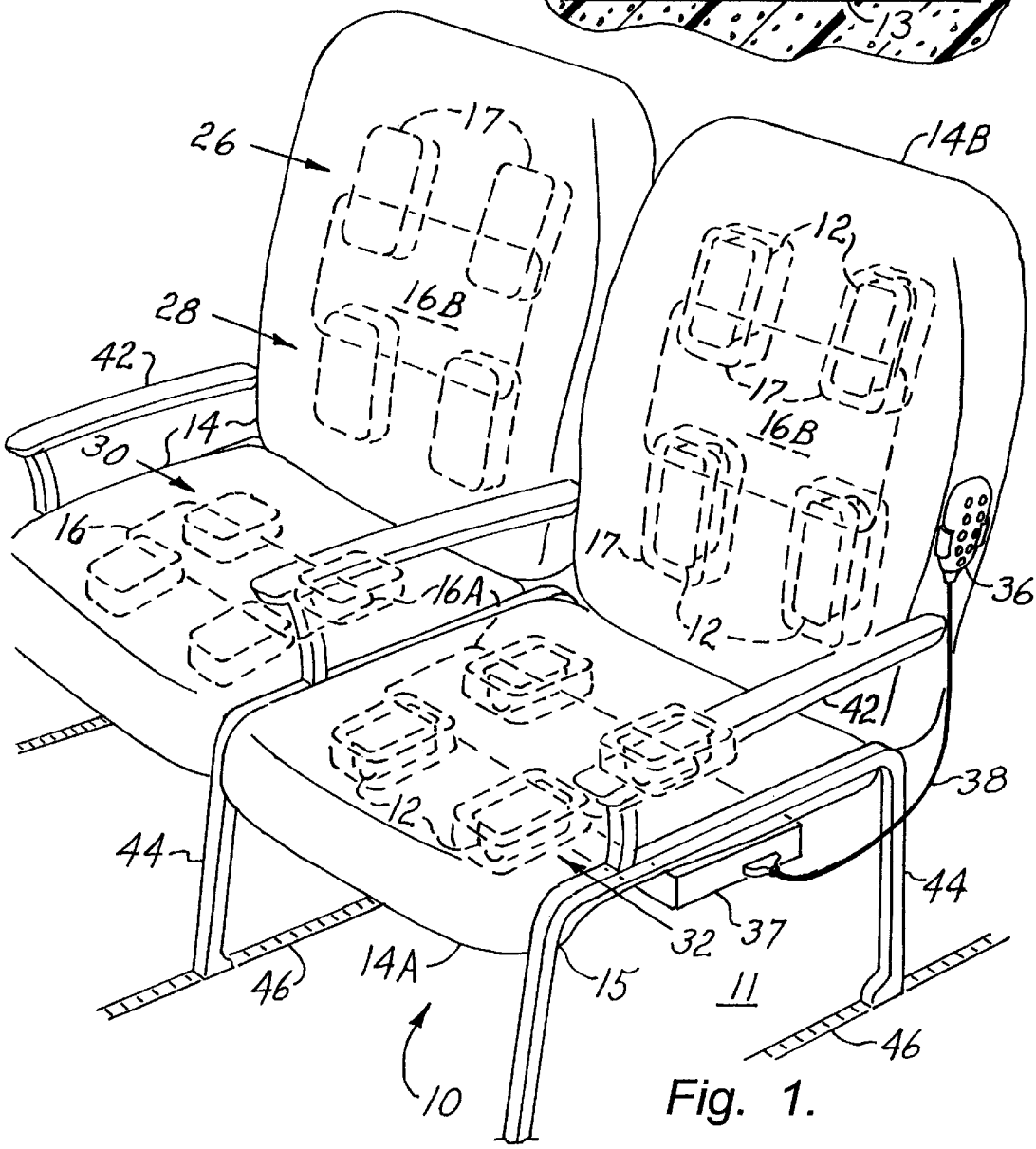
FIG. 1 is a perspective view of a dual vehicle seat unit incorporating a massaging system according to the present invention.

The present invention is directed to a massaging system that is particularly effective in selectively massaging local muscle groups of a user, while limiting transmission of vibrations to adjacent seating and structure. With reference to FIGS. 1–4 of the drawings, the present invention comprises a microcontroller based massaging system 10 that is installed in equipment such as a vehicle, a vehicle floor being designated 11 in FIG. 1. The system 10 has a plurality of vibrators 12 that are embedded in a massage pad 14 which can form a portion of a seat 15. FIG. 1 shows separate counterparts of the system 10 in a side-by-side pair of seats 15, the seats 15 being structurally joined as further described below. In the exemplary seat 15, there is a seat cushion 14A and a separate back cushion 14B. The system 10 may also contain embedded heaters 16 such as a seat heater 16A and a back heater 16B for enhanced massaging of the user. Each vibrator 12 has a housing 13 being further described below, and may comprise a conventional combination of a small DC motor that rotates an eccentric weight, or if desired, a pair of eccentrics at opposite ends of the motor, the vibrators 12 being sometimes referred to herein as motors. It will be understood that other forms of vibrators may be used. Also, the massage pad 14 can be a separate device that is not integrated with the seat 15. The pad 14 may be divided into foldable sections such as an upper section being the back pad 14B (for supporting the upper and lower back of the user), and a lower section being the seat pad 14A (for supporting the user's hips and thighs). It will be understood that the pad 14 can also include a further section for stimulation and/or massaging of the user's calves.

Figure 3:
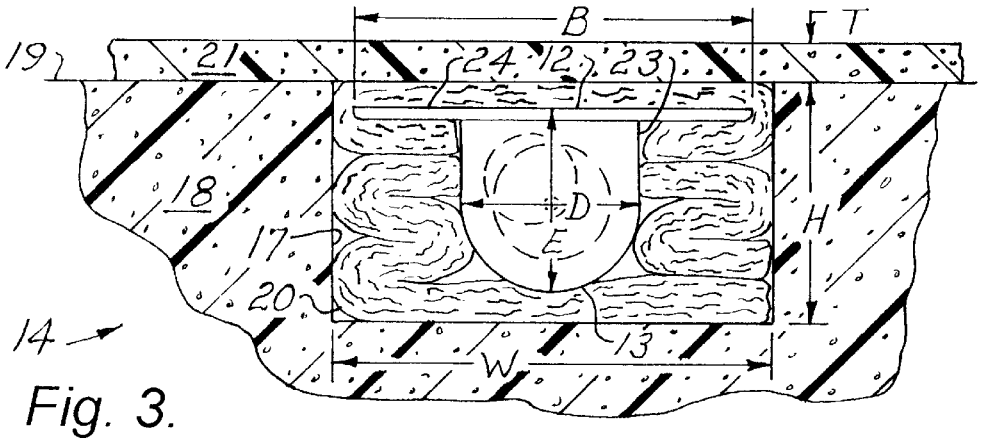
FIG. 3 is a sectional view of the system portion of FIG. 2.
Figure 2:
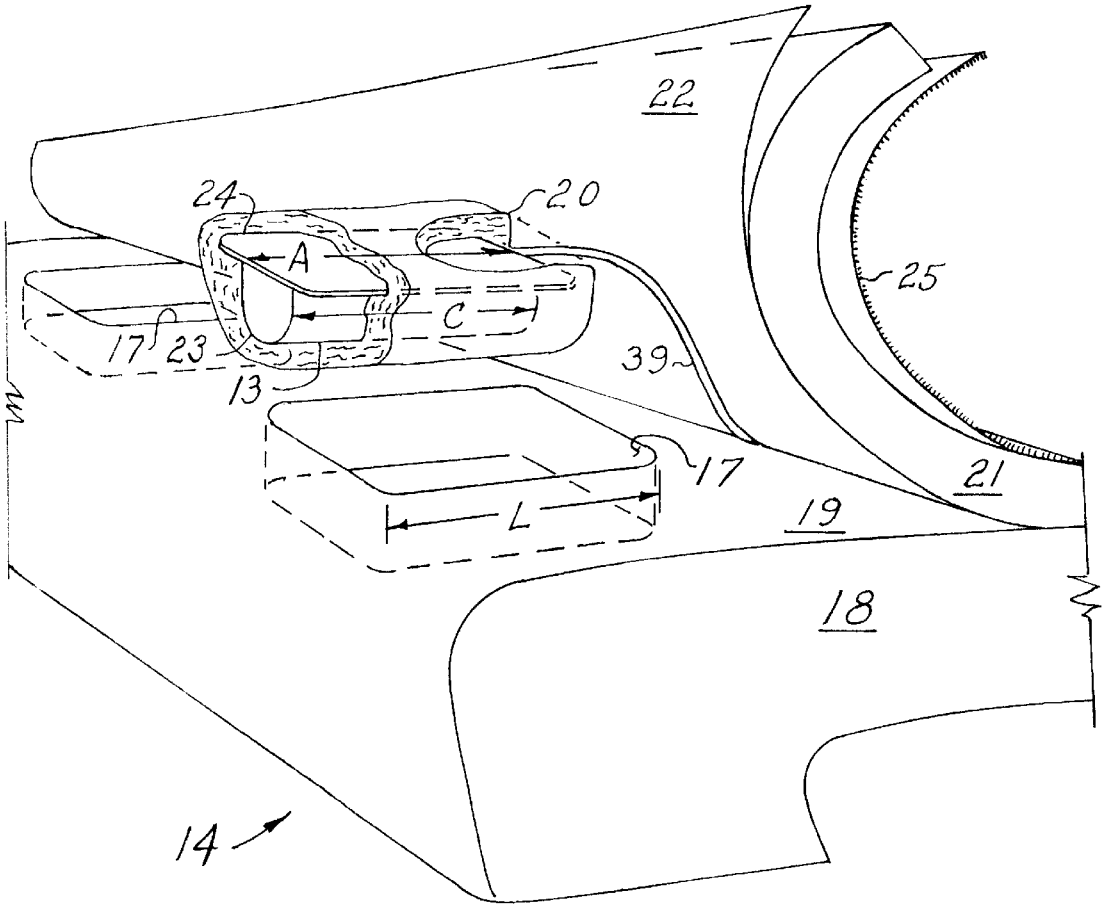
FIG. 2 is an enlarged partially exploded perspective view of a cushion portion of the system of FIG. 1.

According to the present invention, each of the vibrators 12 is located in a cavity 17 that is formed in a main cushion member 18 of the seat 15, an isolation member 20 being interposed between the housing 13 and the cushion member 18 for suppressing the coupling of vibrations of the housing 13 to the cushion 18. The cavity 17 interrupts a main supporting surface 19 of the cushion 18. An outer cushion member 21 is bonded to the main supporting surface 19, thereby enclosing respective ones of the vibrators 12 and the isolation members 20 in the cavities 17. Preferably a flexible reinforcing sheet member 22 is laminated between the main cushion member 18 and the outer cushion member 21, the sheet member 22 also covering the cavities 17. Preferably, the housing 13 is formed for enhanced coupling of vibrations into the outer cushion member 20 relative to the suppressed coupling to the main cushion member 18. Accordingly, each housing 13 is formed (such as by molding) with a generally cylindrical body portion 23 and a generally planar plate portion 24, the housing 13 being oriented with the plate portion 23 facing the outer cushion member 21 in parallel relation thereto. As shown in FIG. 3, the plate portion 24 projects beyond opposite sides of the body portion 23 for presenting an enhanced surface area of the plate portion in close proximity to the outer cushion member 21, a lower portion of the body portion being circularly cylindrical for limited area proximity of the housing 13 with the main cushion member 18. The plate portion 24 can also project beyond opposite ends of the body portion 23 as further shown in FIG. 1. More particularly, each housing 13 has a length A and a width B of the plate portion, the body portion having a length C and a width corresponding to a diameter D of the bottom portion, the housing 13 also having a depth E approximately corresponding to the diameter D. The cavity 17 has a length L that exceeds the length A by a distance that is sufficient for accommodating layers of the isolation member 20 at opposite ends of the housing 13, that distance being preferably between 0.2 inch and 0.5 inch. Also, the cavity 17 has a width W that exceeds the width B by a corresponding distance, and a depth or height H that exceeds the depth E by a distance that is also preferably between 0.2 inch and 0.5 inch. In an exemplary configuration of the system 10, the approximate dimensions of the housing 13 are A=3.5 inches, B=2.5 inches, C=2.0 inches, D=1.15 inches, and E=1.19 inches; the approximate dimensions of the cavity 17 being L=3.75 inches, W=2.75 inches, and H=1.5 inches. Corner extremities of the cavity 17 are rounded, having a corner radius which can be approximately 0.4 inch, the plate portion 24 of the housing 13 correspondingly having a corner radius (which can be approximately 0.2 inch) as shown in FIG. 2 for maintaining clearance between the vibrator 12 and the main cushion member 18. Preferably, the isolation member 20 occupies at least 40 percent of the volume of each cavity 17. As further shown in FIGS. 2 and 3, a layer of the isolation member 20 extends between the plate portion 24 and the outer cushion member 21 (and the sheet member 22).

Suitable materials for the main cushion member 18 and the outer cushion member 21 include conventional closed-cell foam padding such as 2-pound mini-cell polyethylene, the outer cushion member 21 preferably having a uniform thickness T that can be approximately 0.25 inch. Thus the massage pad 14 has a foam core including the cushion members 18 and 21. Typically the main cushion member 18 has a thickness on the order of 2 or 2.5 inches. Each massage pad 14 also typically has an outer flexible seat cover 25 as shown in FIG. 2, which can be made from a decorative material such as sheepskin fur. A suitable material for the isolation member 20 is Kodel™ fiber, available from Kodak of Rochester, N.Y. A suitable material for the sheet member 22 is Typar™ cloth, available from Reemay, Inc. of Old Hickory, Tenn. The material of the isolation member 20, in a free thickness of approximately 0.5 inch, is wrapped at least partially about each vibrator 12. In the exemplary configuration of FIGS. 1–3, the isolation member 20 completely surrounds the housing 13, being accordion-folded in regions of the cavity 17 beneath the outwardly projecting portions of the plate portion 24. As further shown in FIG. 3, the isolation member 20 can be formed of separate pieces, one being placed into the cavity 17 prior to insertion of the vibrator 12, the other being wrapped over upper and lower surfaces of the plate portion 24. The sheet member 22 is first bonded to the outer cushion member 21 by a suitable adhesive such as a spray foam adhesive and, after the vibrators 12 and the isolation members 20 are in place, the combination of the members 21 and 22 is bonded to the supporting surface 19 of the main cushion member 18 by a further quantity of the adhesive. A suitable spray adhesive is Super 77™ Spray Adhesive, available from Minnesota Mining and Manufacturing Corp. of St. Paul, Mn. When a pad 14 is provided with a heater 16, the heater is bonded to the outer cushion member 21 opposite the sheet member 22, being covered by the seat cover 25, which can also be bonded to the cushion member 21 and the heater 16.

In the exemplary configuration shown in FIG. 1, the pads 14 collectively have eight vibrators 12 arranged in groups of two motors in four zones, as follows: (1) a first zone 26 for the left and right sides of the shoulder area; a second zone 28 for the left and right sides of the lower back; a third zone 30 for the left and right hips; and a fourth zone 32 for the left and right thighs. Typically, the seat heater 16A is centrally located between the hip and thigh areas 30 and 32, and the back heater 16B is centrally located in or between the shoulder and lower back areas 26 and 28. It will be understood that other groupings and numbers of zones are contemplated.

Figure 4:
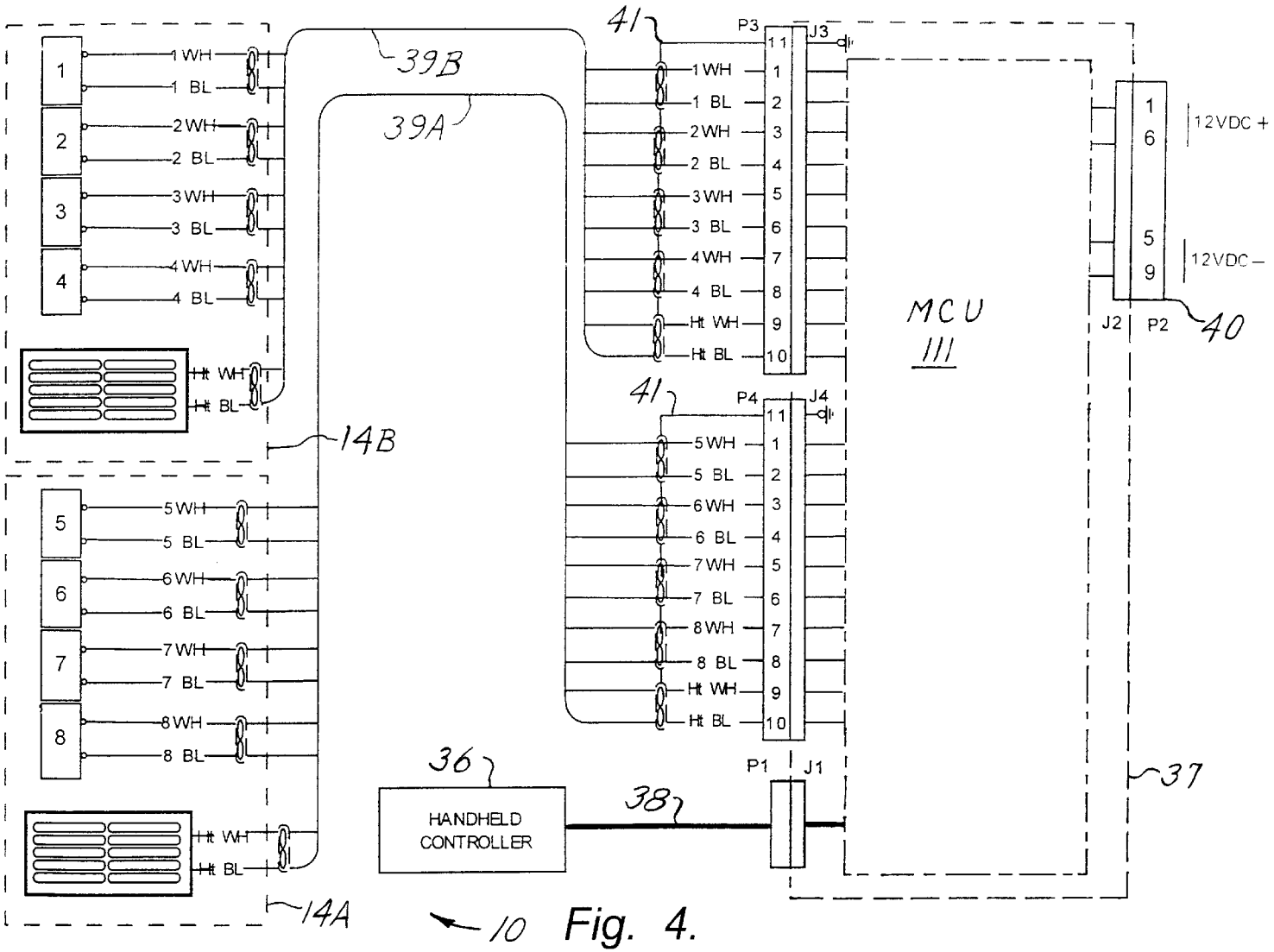
FIG. 4 is a wiring diagram of the system of FIG. 1.

The system 10 is activated via a remote control device or wand 36 containing push buttons or keys and visual status indicators, as more fully described in copending U.S. patent application Ser. No. 09/081,402 that was filed on May 18, 1998, and which is incorporated herein by this reference. The wand 36 is removably coupled to an electronics module 37 via a cable 38, the module 37 having a programmed microcontroller (MCU) 111 for driving the vibrators 12 and heaters 16 as described in the above-referenced patent application. In an exemplary implementation, the electronics module 37 is mounted under the seat pad 14A, being electrically connected to the vibrators 12 and the heaters 16 by separate wiring harnesses 39, designated seat harness 39A and back harness 39B as indicated in FIG. 4, wiring to the individual vibrators 12 (and the heaters 16) passing between the main cushion member 18 and the sheet member 22 into respective ones of the cavities 17 as shown in FIG. 3. Alternatively, passages can be cut into the main cushion member 18 for passing conductors of the harness 39. Similarly, a thermostat of the heater 16 can be imbedded in the main cushion member 18. The wand 36 and the massage pad 14 are powered through a power cable 40 from a suitable source such as DC power of the vehicle 11. In applications wherein electromagnetic interference is a factor (such as the vehicle 11 being an aircraft), the harnesses 39 are provided with grounded shielding as indicated at 41, and the vibrators 12 can be provided with suitable bypass capacitors. It will be understood that suitable batteries for operating the system 10 can be located within the pad 14 or the electronics module 37. The control wand 36 provides a variety of functions or modes which are performed through the manipulation of buttons, keys or equivalent means, with corresponding indicators that designate selected functions and modes as further described in the above-referenced copending patent application. It will be understood that some or all of the control functions of the MCU 111 can be incorporated in the wand 36. Further, the wand 36 can built into an arm 42 of the seat 15 instead of being a hand-held unit as shown in FIG. 1.

Thus each vibrator 12 is caused to vibrate as the eccentric weight rotates, thereby deforming primarily selected regions of the outer pad member 21 and coupling the vibrations for stimulating and/or massaging muscle tissue of the user.

As further described in the referenced copending application, power is turned on or off by a "PWR" button on the wand 36, the PWR button also acting as a double action key for selecting massage duration, and optionally entering test and demonstration modes. The four zones 26–32 are individually actuable by pressing corresponding buttons, with visual status indications being provided by respective lights disposed adjacent the buttons. Other buttons control the heaters 16 and various modes of operation of the vibrators 12, such as select, wave, pulse and zig-zag massaging modes. Additional buttons can control intensity and the speed of progression of the various modes. Additional optional features and modes are described in commonly owned copending application Ser. No. 09/071,357, entitled Microcontroller Based Massage System, that was filed on Apr. 28, 1998, being incorporated herein by this reference.

As further shown in FIG. 1, the side-by-side pair of seats 15 include structural supports in the form of leg frames 44. One of the frames 44 is shared between adjacent ones of the seats 15, additional structure (not shown) connecting the frames 42 beneath and/or within the massage pads 14. Typically, the frames 44 are secured to the vehicle floor 11, such as by respective track members 46.

Figure 5:
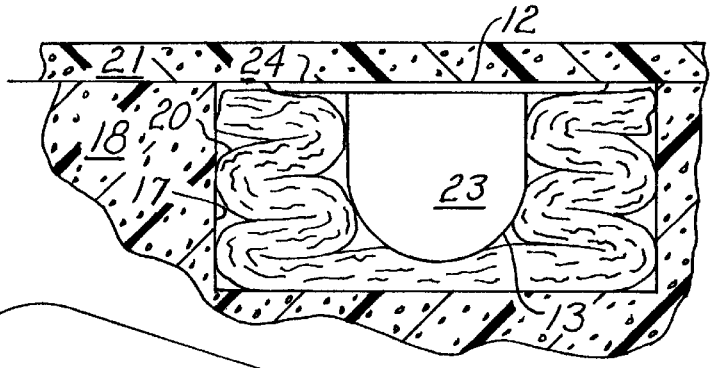
FIG. 5 is a sectional view as in FIG. 3, showing an alternative configuration of the cushion portion of FIG. 2.

With further reference to FIG. 5, the plate portion 24 of each vibrator housing 13 can be bonded directly to the sheet member 22 instead of having the isolation member 20 interposed therebetween. In this configuration, there is significantly greater coupling of vibrations into the outer cushion member 21 without greatly increased coupling to the main cushion member 18. Also, the bonding of plural vibrators 12 to the outer cushion member 21 (and the sheet member 22, if present) provides an inexpensive to produce subassembly that greatly facilitates fabrication of the massaging system 10 in many applications.

Figure 6:
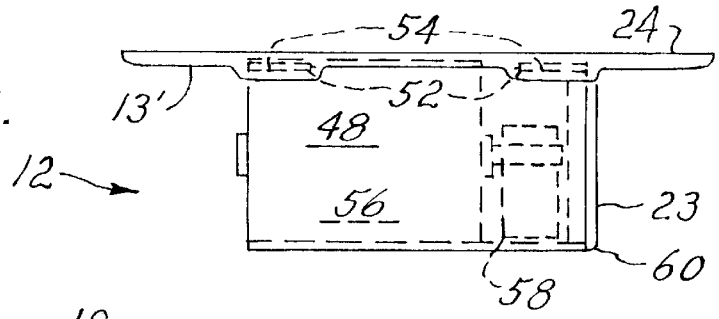
FIG. 6 is a side view showing an alternative configuration of a vibrator portion of the system of FIG. 1.
Figure 7:
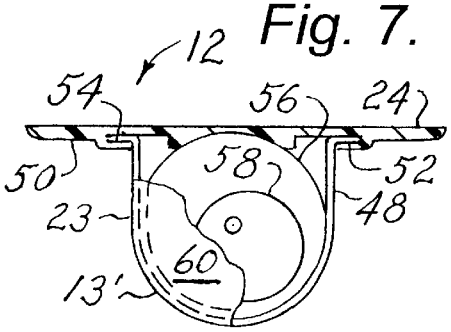
FIG. 7 is a fragmentary sectional end view of the vibrator portion of FIG. 6.

With further reference to FIGS. 6 and 7, each vibrator 12 can have a counterpart of the housing, designated 13', wherein the body portion 23 is formed by a U-shaped sheet metal holder 48, the plate portion 24 being formed by a molded plate member 50, outwardly projecting tab portions 52 of the holder 48 engaging respective pockets 54 that are formed in the plate member 50. A motor 56 having an eccentric mass 58 is retained between the holder 48 and the plate 50, the housing 13' further including a cap member 60 for insuring that fibers of the isolation member 20 are prevented from coming into contact with the eccentric mass 58.

Figure 9:
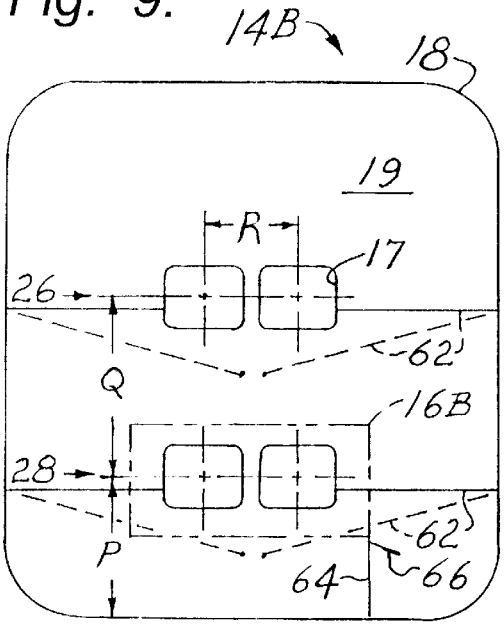
FIG. 9 is an elevational view showing an alternative configuration of a back cushion portion of the system of FIG. 1.
Figure 8:
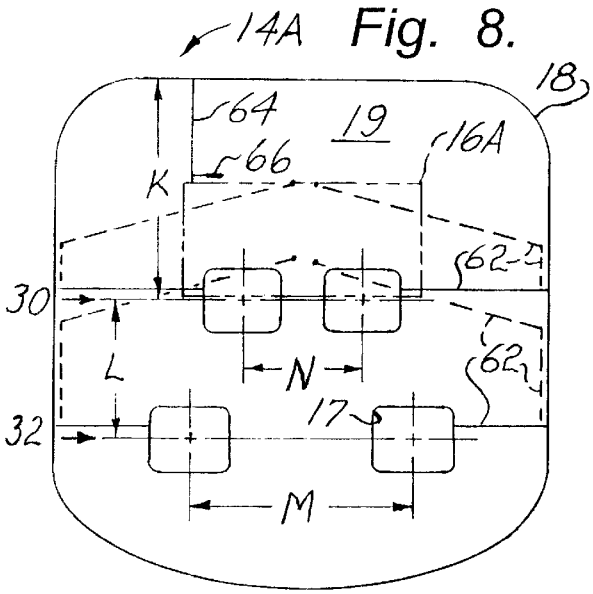
FIG. 8 is a plan view showing an alternative configuration of a seat portion of the system of FIG. 1.

With further reference to FIGS. 8 and 9, an alternative configuration of the massaging system 10 has provisions for wiring to the vibrators 12 passing laterally from the cavities 17 and around side extremities of the main cushion members 18 to locations opposite the supporting surfaces 19. For this purpose, a passage or slot 62 is cut from each cavity 17 to a depth of approximately 0.5 inch for receiving respective pairs of conductors of the corresponding wiring harness 39. The conductors are dressed into the slots 62, which are then sealed shut using a suitable adhesive, such as the above-identified spray adhesive.

FIGS. 8 and 9 also show an exemplary and preferred arrangement of the cavities 17 in the seat pad 14A and the back cushion 14B. Particularly regarding the seat cushion 14A, one pair of the cavities 17 (for the hips zone 30) is centered at a distance K from a rear extremity of the pad 14A, another pair of the cavities (for the thighs zone 32) being spaced forwardly a distance L beyond the distance K as shown in FIG. 8. The cavities 17 for the thighs zone 32 are laterally spaced laterally by a center distance M, the cavities 17 for the hips zone 30 being spaced laterally by a distance N that is preferably less than the distance M. Also regarding the back cushion 14B, one pair of the cavities 17 (for the lower back zone 28) is centered at a distance P from a bottom extremity of the pad 14B, another pair of the cavities (for the upper back zone 32) being spaced upwardly a distance Q beyond the distance P as shown in FIG. 9. The cavities 17 for the upper and lower back zones 26 and 28 are laterally spaced laterally by a center distance R. In the preferred arrangement, the distances are approximately K=9.5 inches, L=6 inches, M=9.5 inches, N=5 inches, P=7.5 inches, Q=6.5 inches, and R=4 inches.

Preferred locations for the heaters 16A and 16B (when present) are further indicated by broken lines in FIGS. 8 and 9. More particularly, the heater 16A is laterally centered within the distance K and partially covering the cavities 17 for the hips zone 30 as shown in FIG. 8. The heater 16A is laterally centered within the distance K and partially covering the cavities 17 for the hips zone 30 as shown in FIG. 8. The heater 16B is laterally centered in the lumbar area, covering the cavities 17 of the lower back zone 28. Counterparts of the slots 62 can be cut into the combination of the main and outer cushion member as indicated at 64 for receiving conductors of the harnesses 39 being connected to the heaters 16. Typically, each heater 16 has a thermostat element 66 wired thereto, a short slit opening having a depth of approximately 1 inch being cut through the outer cushion member 21 for receiving the thermostat element 64. The slit and the slot 64 for each of the heaters 16 (if present) are also adhesively sealed as described above once the wiring is in place.

The system 10 of the present invention is also applicable to existing seating as described herein. A method for converting a padded support device to produce isolated massaging of a user's body includes steps of:

1. Removing an outer cover of the device if present for exposing a main cushion thereof;

2. Providing a counterpart of the transducer 12 having conductors of the harness 39 extending therefrom;

3. Enclosing at least a portion of the housing 13 in a resilient material forming the isolation member 20 and having a bulk stiffness that is less than a bulk stiffness of the main cushion;

4. Forming a counterpart of the cavity 17 in the main cushion, the cavity interrupting a user-supporting surface of the cushion and being sufficiently large for receiving the combination of the transducer 12 and the isolation member 20;

5. Placing the transducer together with the isolation member in the cavity 17;

6. Positioning the harness to extend from the cavity to an edge margin of the cushion;

7. Providing a counterpart of the outer cushion member 21 for covering the supporting surface;

8. Bonding a counterpart of the reinforcing sheet member 22 to a bottom surface of the outer cushion member; and 9. Bonding the sheet member to the supporting surface, the sheet member being laminated between the main cushion and the pad member and covering the cavity 17.

Thus it is believed that the system 10 of the present invention is effective for both improving the selectivity of massaging action as well as for preventing unwanted vibrations being conducted into adjacent seating or other structure.

Although the present invention has been described in considerable detail with reference to certain preferred versions thereof, other versions are possible. For example, the sheet member 22 is not required to completely cover the supportive surface 19. Instead, the sheet member can be sufficiently large to extend some distance beyond opposite sides of the cavities 17 of the corresponding massage pad 14; alternatively, smaller pieces of the material can be used to cover pairs of the cavities or, if the cavities are sufficiently spaced, single pieces of the sheet material can be bonded over individual ones of the cavities 17. Also, one or both of the heaters 16 can be bonded to the sheet member 22, either in facing relation to the main cushion member 18 or to the outer cushion member 21, prior to the bonding to the supporting surface 19. Moreover, the heater 16 can serve as a reinforcing closure of at least some of the cavities 17, replacing some or all of the sheet member 22. Therefore, the spirit and scope of the appended claims should not necessarily be limited to the description of the preferred versions contained herein.

What is claimed is:

1. A massaging apparatus comprising:

(a) a vibrator unit including a housing, a motor supported within the housing, means for connecting the motor to a source of electrical power, the motor being coupled to a mass element for producing vibratory motion of the housing;

(b) a main cushion member having a main supporting surface and being formed of a resilient material having a first volumetric stiffness, a cavity being formed therein and interrupting the supporting surface for receiving the vibrator unit, the cavity being sufficiently large to provide clearance space on all sides of the vibrator unit;

(c) a isolation member having a second volumetric stiffness being less than the first volumetric stiffness, the isolation member covering at least a portion of the vibrator unit and being interposed between the vibrator unit and the main cushion member; and (d) an outer cushion member having a third volumetric stiffness being greater than the second volumetric stiffness, the outer cushion member being bonded to the main supporting surface and covering the cavity, the outer cushion member forming an outer supporting surface being spaced from the main supporting surface.

2. The massaging apparatus of claim 1, wherein the vibrator housing has a generally cylindrical body portion and a plate portion, the plate portion facing the outer cushion member in generally parallel relation thereto.

3. The massaging apparatus of claim 2, wherein the plate portion projects beyond opposite sides of the body portion.

4. The massaging apparatus of claim 3, wherein the plate portion projects beyond opposite ends of the body portion.

5. The massaging apparatus of claim 2, wherein a lower portion of the housing body portion is circularly cylindrical, having an outside diameter D, the housing also having a depth approximately corresponding to the diameter D in a direction perpendicular to the plate portion.

6. The massaging apparatus of claim 2, wherein the plate portion has a length A and a width B, and the cavity has a length L and a width W, the width W being between 0.2 inch and 0.5 inch greater than the width B, the length L being between 0.2 inch and 0.5 inch greater than the length A.

7. The massaging apparatus of claim 6, wherein the housing has a depth E and the cavity has a height H, the height H being between 0.2 inch and 0.5 inch greater than the depth E.

8. The massaging apparatus of claim 6, wherein the Length L is approximately 3.75 inch and the width W is approximately 2.75 inch.

9. The massaging apparatus of claim 8, wherein the height H is approximately 1.5 inch.

10. The massaging apparatus of claim 2, wherein the isolation member occupies at least 40 percent of an overall volume of the cavity.

11. The massaging apparatus of claim 1, further comprising a reinforcing sheet member laminated between the main cushion member and the outer cushion member.

12. The massaging apparatus of claim 11, wherein the outer cushion member is of substantially uniform thickness.

13. The massaging apparatus of claim 12, wherein the thickness of the outer cushion member is between 0.18 inch and 0.4 inch.

14. The massaging apparatus of claim 12, wherein the thickness of the outer cushion member is approximately 0.25 inch.

15. The massaging apparatus of claim 1, wherein the vibrator is one of a spaced plurality of vibrators, each vibrator being located in a corresponding counterpart of the cavity and having a corresponding isolation member interposed between the housing and the cavity.

16. The massaging apparatus of claim 15, wherein the outer cushion covers each of the cavities.

17. The massaging apparatus of claim 15, wherein the main cushion and the outer cushion form a seat pad of a seat.

18. The massaging apparatus of claim 17, in combination with a back pad of the seat, the back pad having counterparts of the vibrators, the main cushion, the isolation members, and the outer cushion.

19. The massaging apparatus of claim 17, wherein the seat is one of a plurality of seats having a common structural element.

20. A vehicle seat comprising a structural member, a seat pad and a back pad supported relative to the structural member, the seat pad and the back pad each comprising:

(a) a plurality of vibrator units, each vibrator unit including a housing, a motor supported within the housing, means for connecting the motor to a source of electrical power, the motor being coupled to a mass element for producing vibratory motion of the housing;

(b) a main cushion member having a main supporting surface and being formed of a resilient material having a first volumetric stiffness, a plurality of spaced apart cavities being formed therein and interrupting the supporting surface for receiving respective ones of the vibrator units, each cavity being sufficiently large to provide clearance space on all sides of the corresponding vibrator unit;

(c) a plurality of isolation members, each isolation member having a second volumetric stiffness being less than the first volumetric stiffness, the isolation member covering at least a portion of a vibrator unit and being interposed between the vibrator unit and the main cushion member; and (d) an outer cushion member having a third volumetric stiffness being greater than the second volumetric stiffness, the outer cushion member being bonded to the main supporting surface and covering the cavities, the outer cushion member forming an outer supporting surface being spaced from the main supporting surface.

21. The massaging apparatus of claim 20, further comprising a controller electrically connected to each of the vibrators for activating selected ones of the vibrators.

22. A method for converting a padded support device to produce isolated massaging of a user's body, the device including a main cushion having a first bulk stiffness, the method comprising the steps of:

(a) providing a vibratory transducer having a housing and a control cable extending from the housing for driving the transducer;

(b) enclosing at least a portion of the transducer housing in a resilient isolation material having a second bulk stiffness being less than the first bulk stiffness;

(c) forming a cavity in a supporting surface of the main cushion, the cavity being sufficiently large for receiving the combination of the transducer housing and the isolation material;

(d) placing the transducer housing together with the isolation material in the cavity;

(e) positioning the control cable to extend from the cavity and on the supporting surface to an edge margin thereof;

(f) providing a resilient pad member for covering the supporting surface;

(g) bonding a reinforcing sheet member to a bottom surface of the pad member; and (h) bonding the sheet member to the supporting surface, the sheet member being laminated between the main cushion and the pad member and covering the cavity.

23. The method of claim 22, wherein the step of enclosing comprises completely enclosing the transducer housing with the isolation material, the isolation material having a volume of not less than 40 percent of a volume of the cavity.

* * * * *